US007503520B2

(12) United States Patent
Eriksson et al.

(10) Patent No.: US 7,503,520 B2
(45) Date of Patent: Mar. 17, 2009

(54) REEL SHAFT AND REEL-UP FOR REELING A PAPER WEB

(75) Inventors: Sören Sven Eriksson, Sugar Hill, GA (US); Tord Gustav Gustavsson, Forshaga (SE); Anders Tommy Lindén, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 1105 days.

(21) Appl. No.: 10/331,112

(22) Filed: Dec. 27, 2002

(65) Prior Publication Data

US 2003/0141403 A1 Jul. 31, 2003

Related U.S. Application Data

(63) Continuation of application No. PCT/SE01/01469, filed on Jun. 27, 2001.

(60) Provisional application No. 60/214,507, filed on Jun. 28, 2000.

(51) Int. Cl.
*B65H 19/28* (2006.01)

(52) U.S. Cl. ..... 242/532.2; 242/533.1; 242/541.1; 242/542.3; 242/596.4; 242/610.6

(58) Field of Classification Search ..... 242/532.2, 242/533.1, 533, 596.4, 541.1, 542.3, 610.6, 242/609, 609.1
See application file for complete search history.

(56) References Cited

U.S. PATENT DOCUMENTS

| | | | | |
|---|---|---|---|---|
| 3,657,797 | A | 4/1972 | Robinson | |
| 3,743,199 | A | 7/1973 | Karr et al. | |
| 4,238,539 | A | 12/1980 | Yates et al. | |
| 4,328,930 | A * | 5/1982 | Kalendovsky | 242/406 |
| 4,606,381 | A * | 8/1986 | Suwa et al. | 139/1 R |
| 4,778,122 | A * | 10/1988 | Snygg | 242/533.1 |
| 5,004,173 | A * | 4/1991 | Kawai | 242/596.4 |
| 5,114,062 | A | 5/1992 | Kuhn et al. | |
| 5,337,968 | A * | 8/1994 | De Bin et al. | 242/521 |
| 5,379,964 | A | 1/1995 | Pretto et al. | |
| 5,387,172 | A | 2/1995 | Habenicht et al. | |
| 5,673,870 | A | 10/1997 | Fielding et al. | |
| 5,810,281 | A * | 9/1998 | Kole | 242/532.6 |

(Continued)

FOREIGN PATENT DOCUMENTS

EP 327048 A2 * 8/1989

(Continued)

*Primary Examiner*—Sang Kim
(74) *Attorney, Agent, or Firm*—Alston & Bird LLP

(57) ABSTRACT

A reel shaft for reeling a paper web in a reel-up, which reel-up includes at least one unit that is mobile in the longitudinal direction of the paper machine and supports a pair of opposite engagement members each of which includes an engagement part, which engagement parts are arranged for rotatably carrying and detachably engaging the reel shaft during reeling. In accordance with the invention, the reel shaft is free of a support shaft and has a self-supporting, tubular sleeve substantially formed of fiber-reinforced plastic, which sleeve has an envelope surface on which the initial wrapping of the paper web shall be performed, and also an internal surface defining an axial channel terminating in axial openings at the ends of the reel shaft. The invention also relates to a reel-up for such reel shafts.

21 Claims, 5 Drawing Sheets

U.S. PATENT DOCUMENTS

| | | | | |
|---|---|---|---|---|
| 5,857,643 | A * | 1/1999 | Czuprynski et al. | 242/613 |
| 6,129,305 | A | 10/2000 | Möller et al. | |
| 6,209,819 | B1 * | 4/2001 | Habisreitinger et al. | 242/559.3 |
| 6,595,458 | B1 * | 7/2003 | Biagiotti | 242/532.2 |
| 2003/0080234 | A1 * | 5/2003 | Baggot et al. | 242/532.3 |

FOREIGN PATENT DOCUMENTS

| | | |
|---|---|---|
| GB | 623155 | 5/1949 |
| WO | WO-02/46076 | 6/2002 |

* cited by examiner

REEL SHAFT AND REEL-UP FOR REELING A PAPER WEB

CROSS-REFERENCE TO RELATED APPLICATION

This application is a continuation of International Patent Application PCT/SE01/01469 filed Jun. 27, 2001, which designated inter alia the United States and was published under PCT Article 21(2) in English, and which claims the benefit of U.S. Provisional Patent Application No. 60/214,507 filed Jun. 28, 2000.

FIELD OF THE INVENTION

The present invention relates to a reel shaft for reeling a paper web in a reel-up in a paper machine, which reel-up includes at least one unit that is mobile in the longitudinal direction of the paper machine and supports a pair of opposite engagement members each of which includes an engagement part, which engagement parts are arranged for rotatably carrying and detachably engaging the reel shaft during reeling.

The invention also relates to a reel-up in a paper machine, in which paper is continuously manufactured in a coherent web that is wound onto reel shafts in the reel-up to form paper rolls, in which the reel shafts constitute reeling cores, which reel-up comprises a stock of empty reel shafts, an advancement unit arranged to move the empty reel shafts sequentially from the stock to a reeling system, and said reeling system, comprising at least one unit that is mobile in the longitudinal direction of the machine and supports a pair of opposite engagement members, each of which comprises an engagement part, which engagement parts are arranged for rotatably carrying and detachably engaging the reel shafts during reeling.

BACKGROUND OF THE INVENTION

During continuous reeling of paper in a reel-up in a modem paper machine, very stringent demands as regards strength are made on the reel spools on which the paper web is wound to form jumbo rolls. A modern paper machine produces paper with a web speed of several thousand meters per minute, and the width of the paper web in such machines is ordinarily in the range 2.5-8 meters. Accordingly, the reel spools must be sturdily dimensioned to withstand the weight of the paper roll and the rotational speed required by the web speed. The demands made on a reel spool in the reel-up of a paper machine are thus completely different from the demands made on reel spools occurring in machines for subsequent processing of the paper roll, for instance rewinders and slitter-winders.

To meet the requisite demands for strength, known types of reel spools comprise a hollow steel reel spool. At its ends, the steel reel spool usually has protruding shaft journals, intended to support the steel reel spool rotatably in the reel-up. In a common type of reel shaft, a paper core is detachably attached to the envelope surface of the steel reel spool by means of a locking device. Thus, the steel reel spool acts as a support shaft for the paper core and, once the paper web has been wound onto the reel spool, the locking device is disengaged from the paper core, whereupon the steel reel spool is extracted from the paper core with the aid of an extraction device. The exposed steel reel spool is thereupon provided with a new paper core and returned to a nearby stock of steel reel spools provided with paper cores to be used in a subsequent reeling sequence. Accordingly, the paper core forms the core of the wound paper roll and thus accompanies the wound paper to subsequent processing procedures. When the paper core in due course is disengaged from the paper during such a processing procedure, for instance during rewinding of the paper roll, an uncovered steel reel spool is inserted into the paper core and thereafter placed in the stock of steel reel spools provided with paper cores for the reel-up.

It is known to cover the steel reel spool with a composite core of fiber-reinforced plastic instead of a paper core. Whereas a paper core must usually be discarded after about three reeling cycles, that is after being mounted on and removed from steel reel spools three times, a plastic composite core has a virtually unlimited service life.

Another type of reel spool is described in U.S. Pat. No. 3,743,199, which, in common with the spindle described above, consists of a steel reel spool, having protruding shaft journals at its ends, intended to support the reel spool rotatably in the reel-up. Unlike the reel spool described above, however, the paper is in this case wound directly onto the envelope surface of the steel reel spool. In addition, at least one of the shaft journals exhibits a channel running axially through the same and communicating with the hollow interior of the steel reel spool, and the envelope surface of the steel reel spool exhibits a plurality of evenly distributed holes running through the same and likewise communicating with the hollow interior of the steel reel spool. When the paper web is to be wrapped around the empty steel reel spool in the initial phase of the reeling, a vacuum pump is connected to the shaft journal exhibiting the through-running channel, or to both shaft journals if both shaft journals exhibit through-running channels, to generate a negative pressure inside the steel reel spool. The negative pressure creates a flow of air in through the holes in the envelope surface of the steel reel spool, which flow of air unsettles the film of air surrounding the paper web so that the paper web can be adjoined to the steel reel spool more easily, thereby facilitating the wrapping of the paper web on the steel reel spool. In this case, however, the steel reel spool must accompany the wound paper to subsequent processing procedures, as the steel reel spool cannot normally be withdrawn from the paper roll without difficulties. When the paper in due course is unreeled from the steel reel spool, the same is returned to the stock of steel reel spools in the reel-up to be used in a subsequent reeling sequence.

Using a reel spool comprising a steel reel spool entails numerous problems, however. As previously mentioned, a reel spool must be dimensioned to satisfy predetermined strength criteria, and, because of the strength criteria, the steel reel spool must be fashioned with a large diameter and substantial material thickness. Consequently, a conventional reel spool has considerable mass and a great moment of inertia with respect to its rotational axis. This makes it very difficult to balance a conventional reel spool and it is almost inevitable that the reel spool must exceed at least one rotational speed that is critical as regards self-oscillation to achieve normal rotational speed for reeling. This subjects both the reel-up and the reel spool to very considerable mechanical stress. Moreover, irrespective of said self-oscillation, the great mass and moment of inertia of the conventional reel spool require the reel-up to have sturdy dimensions to support, control, accelerate, and decelerate the reel spool. The great mass of the conventional reel spool also makes it very difficult to regulate the linear load in the paper web, especially in the initial phase of the reeling, as the weight of the reel spool greatly outweighs the linear load. A further problem arises in such cases where the finished paper roll rests on a plane surface with the reel spool still in place at the center of the paper roll, as sometimes occurs. In such cases, the paper roll can be deformed under the weight of the reel spool. This is a problem particularly in the manufacture of soft crepe paper, where costly additional equipment is necessary to relieve the mass of the reel spool so that the paper roll is not damaged by compression. Besides, the target aimed at in the current trend, especially in the manufacture of soft crepe paper, is ever higher web speeds, which, to satisfy strength requirements, necessitates steel reel spools with ever greater diameters and that are ever more rigid and heavy, which accentuates the above-mentioned problems.

A further problem can arise when using a reel spool of the type described above, which is that a gap can arise between the steel reel spool and the paper or plastic composite core covering the steel reel spool during reeling. When such a gap arises, balancing faults occur, which make it difficult to regulate the linear load. This is a problem particularly when using paper cores, as paper cores can be difficult to manufacture within the margins of tolerance that ensure a good fit between the paper core and the steel reel spool. Further, paper cores are not particularly stable in shape, which means that they can lose their original shape during the course of processing.

Another problem additionally arises in the reel spool described in U.S. Pat. No. 3,743,199. The shaft journals and their fastenings in the steel reel spool must be sturdily dimensioned, because of the weight of the steel reel spool. In reel spools of this type, the cross-sectional area of the channel in the shaft journal through which air is extracted from the hollow interior of the steel reel spool is therefore small relative to the cross-sectional area of the channel forming the hollow interior of the steel reel spool. As the limited cross-sectional area of the channel in the shaft journal constitutes an obstacle to the flow of air, it can be difficult to achieve the desired negative pressure inside the steel reel spool during the initial wrapping.

SUMMARY OF THE INVENTION

A main object of the present invention is to provide a reel shaft for reeling a paper web that at least substantially alleviates the problems associated with the great mass and moment of inertia of conventional reel shafts.

A further object of the invention is to provide a reel shaft that completely eliminates the above-mentioned problems with a loose-fitting paper or plastic composite core.

Another object of the invention is to provide a reel shaft that at least substantially alleviates the problem that arises during initial wrapping aided by negative pressure due to the great mass and moment of inertia of conventional reel shafts.

The reel shaft and the reel-up in accordance with the invention are wherein the reel shaft is free of a support shaft and includes a self-supporting, tubular sleeve, substantially consisting of fiber-reinforced plastic, which sleeve has an envelope surface on which the initial wrapping of the paper web shall be performed, and also an internal surface, defining an axial channel in the sleeve, terminating in axial openings at the ends of the reel shaft.

Stating that the reel shaft lacks a support shaft here denotes that it does not have a shaft running through it axially to give the sleeve radial support. Accordingly, the sleeve is self-supporting, that is to say that the sleeve in itself possesses the requisite strength for reeling machine reels, which means that the sleeve has a strength that is on a par with the strength of steel reel spools in known reel shafts. However, by virtue of the reel shaft being manufactured of fiber material impregnated with a plastic material, the reel shaft is considerably lighter than conventional reel shafts. The previously described problems relating to the great weight and moment of inertia of conventional reel shafts are thereby significantly alleviated.

Moreover, the aforementioned problem with a gap between the tubular roll and the paper or plastic composite core is eliminated in that the reel shaft does not need an axial support shaft.

In accordance with one embodiment of the reel shaft, the sleeve exhibits a plurality of holes passing through its envelope surface. By fashioning at least one of said engagement members with an axial through-running channel that communicates with the channel of the sleeve and through which the reel shaft can be connected to a vacuum system for creating a negative pressure inside at least a part of the reel shaft, a reel shaft for initial wrapping aided by negative pressure is provided that is lightweight thanks to its plastic composite material. Consequently, the cross-sectional area of the channel in the engagement member can be made large without the strength of the engagement member being jeopardized.

BRIEF DESCRIPTION OF THE DRAWINGS

Figure 1:
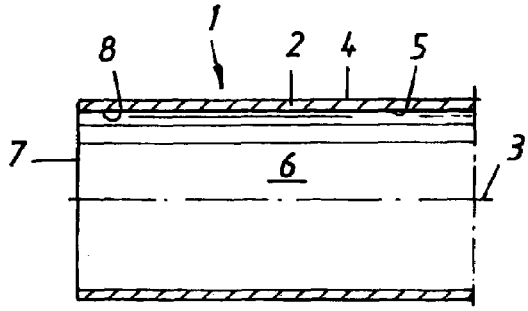

Having thus described the invention in general terms, reference will now be made to the accompanying drawings, which are not necessarily drawn to scale, and wherein:

FIG. 1 shows a first embodiment of a reel shaft in accordance with the invention.

Figure 2:
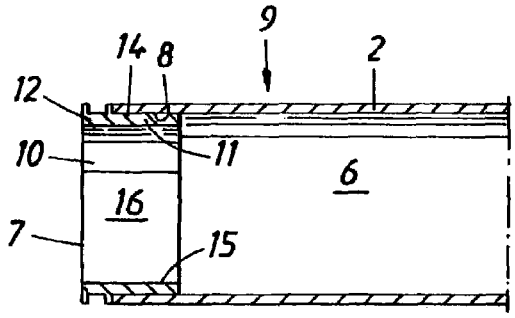

FIG. 2 shows a second embodiment of a reel shaft in accordance with the invention, which reel shaft comprises reinforcement members.

Figure 3:
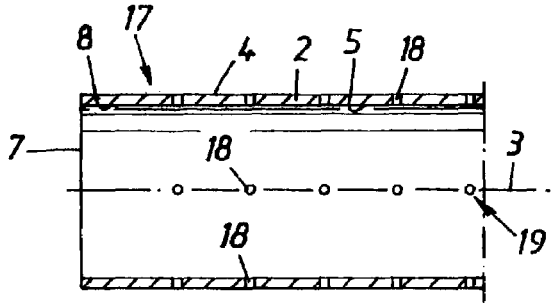

FIG. 3 shows a third embodiment of a reel shaft in accordance with the invention, which reel shaft exhibits holes passing through it.

Figure 4:
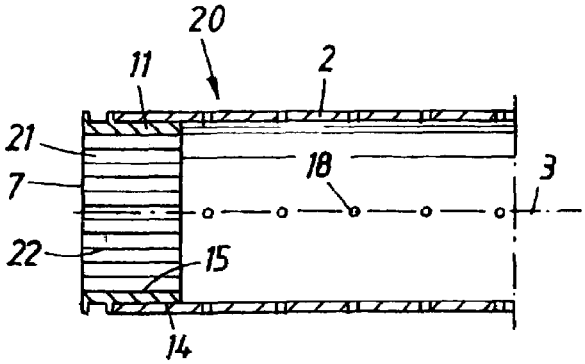

FIG. 4 shows a fourth embodiment of a reel shaft in accordance with the invention, which reel shaft comprises reinforcement members with bar grooves or splines.

Figure 5:
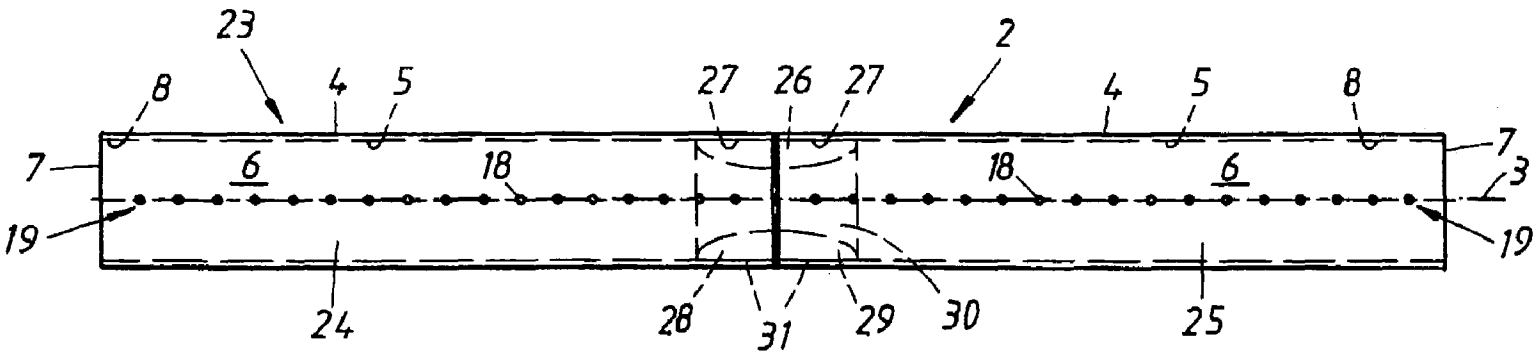

FIG. 5 shows a fifth embodiment of a reel shaft in accordance with the invention, which reel shaft comprises two sleeve parts.

Figure 6:
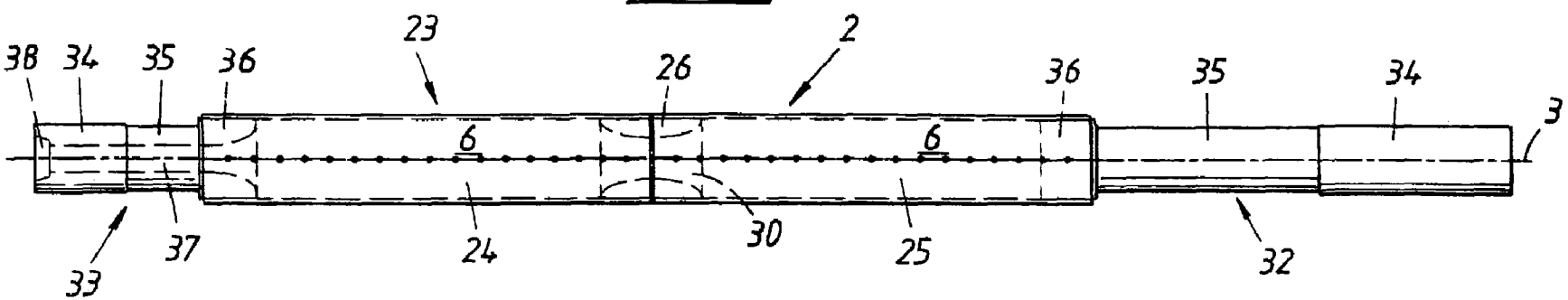

FIG. 6 shows the reel shaft from FIG. 5 with connected engagement members.

Figure 7:
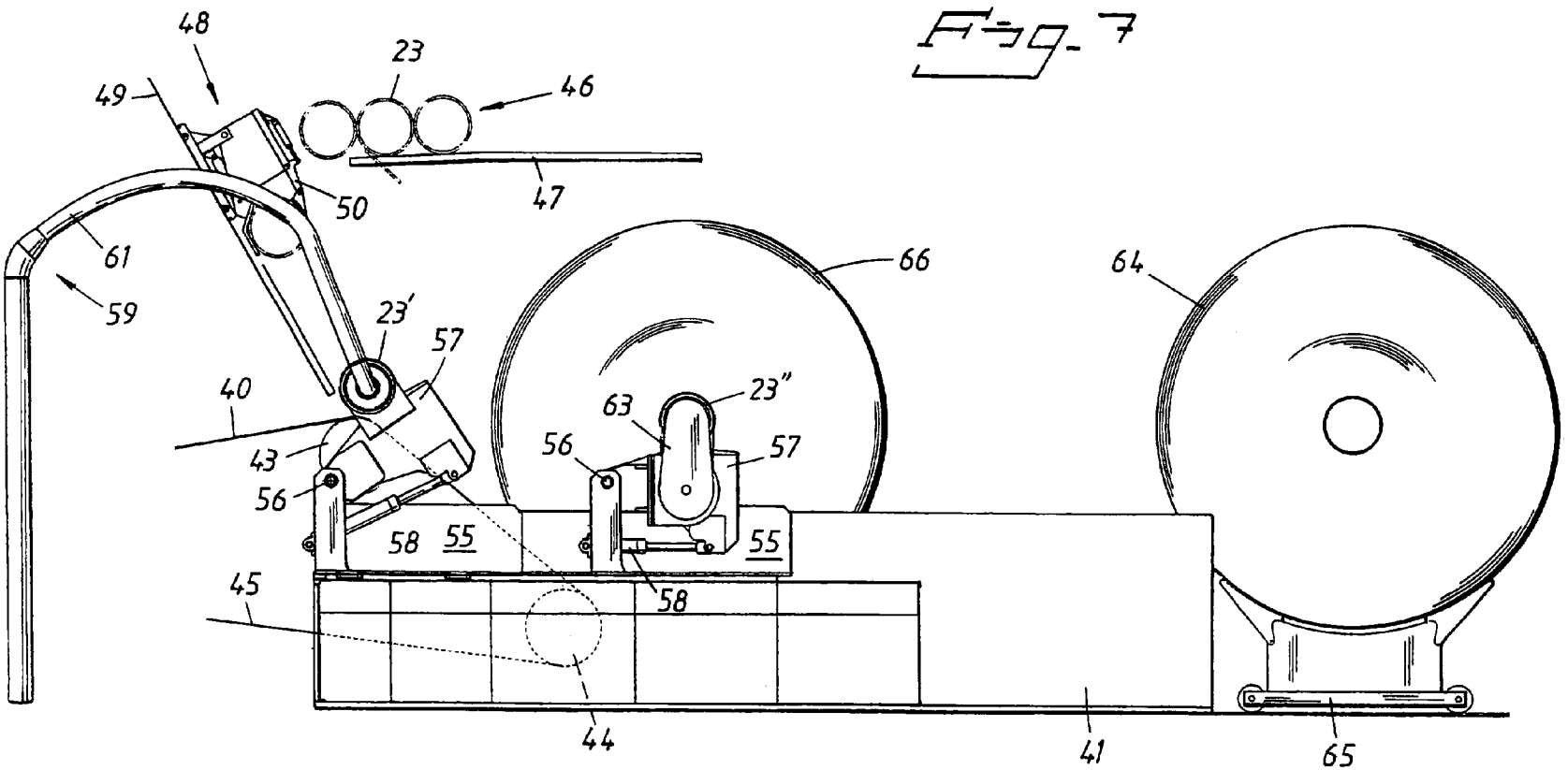
Figure 8:
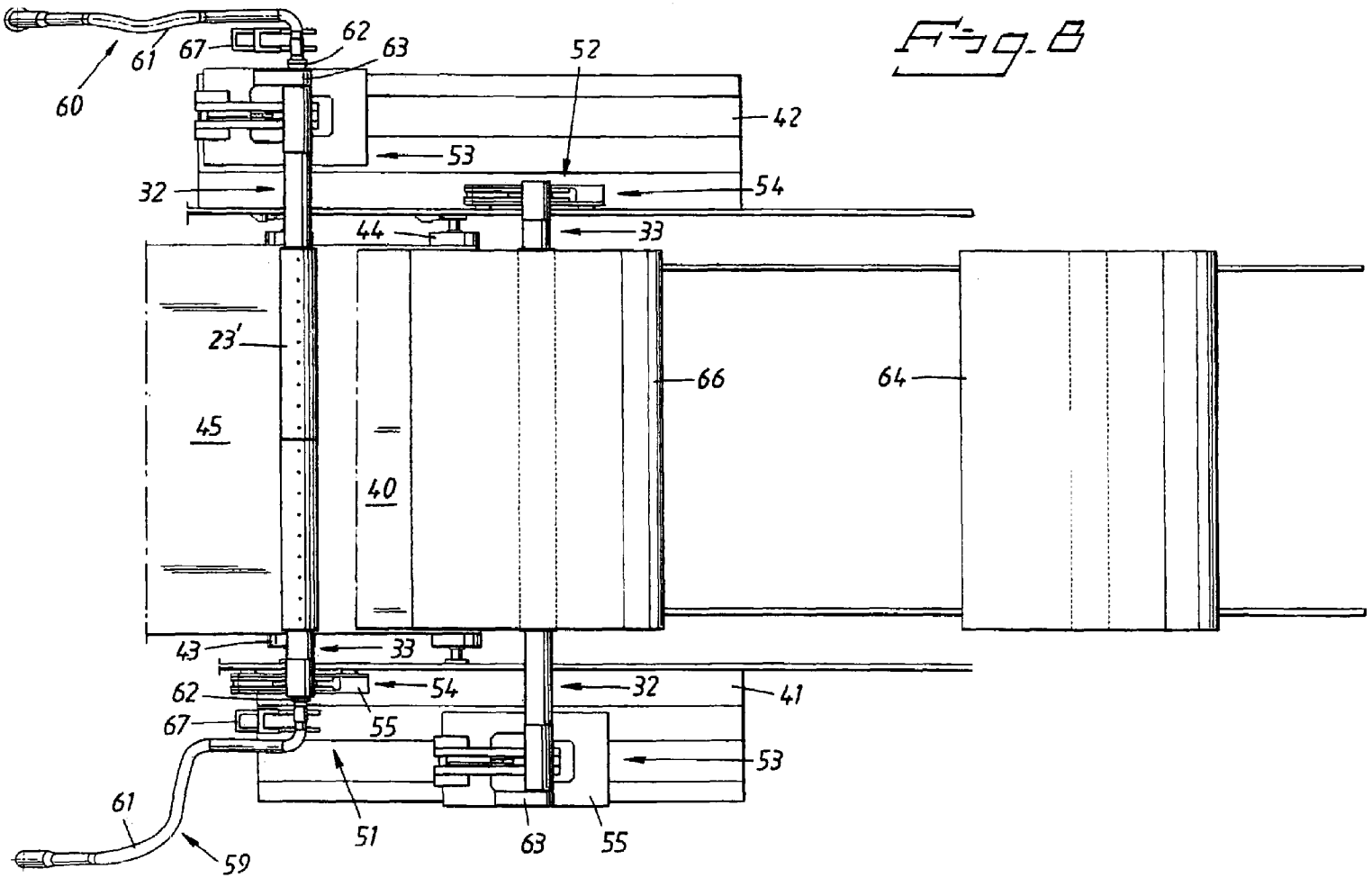
Figure 4:
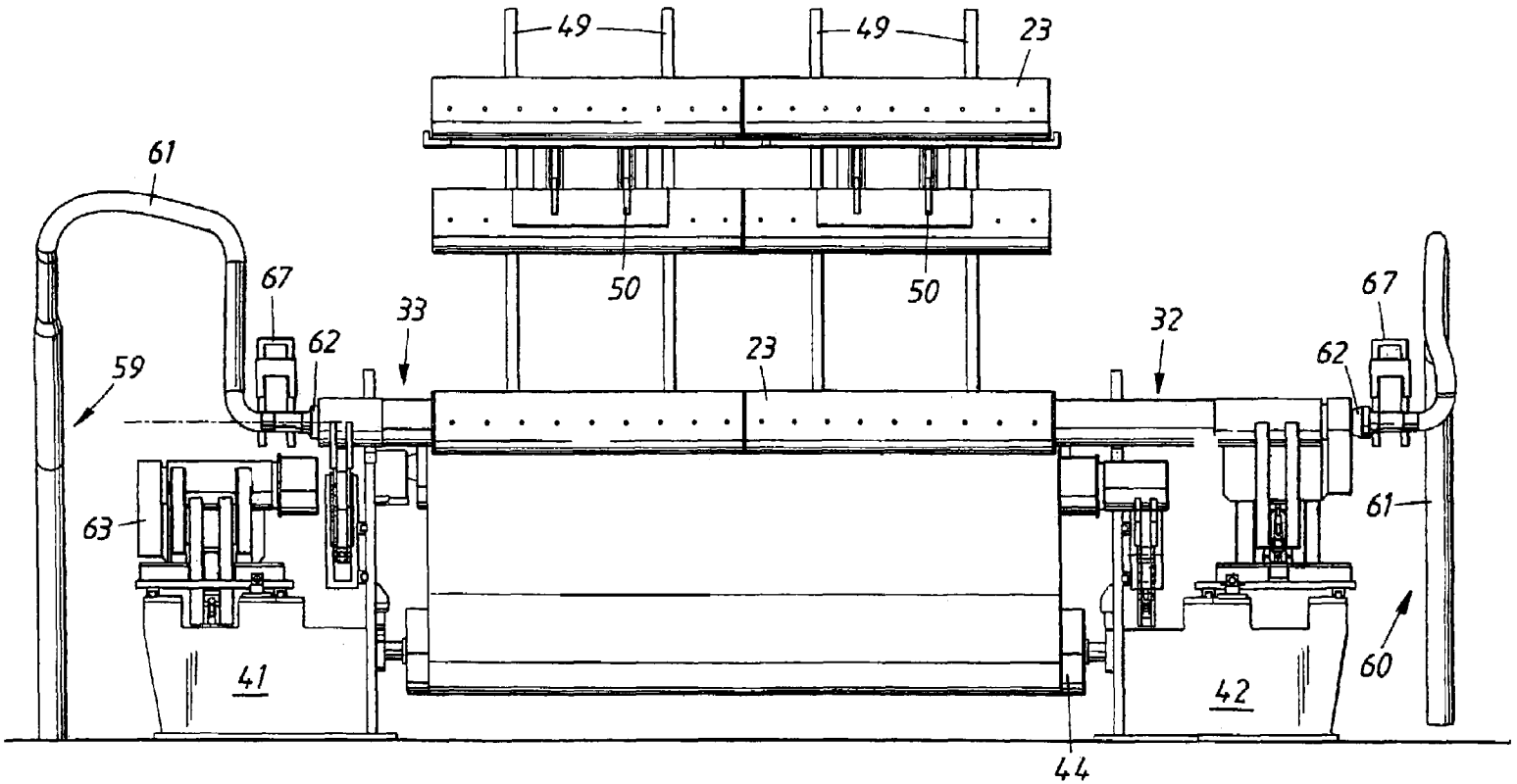

FIGS. 7-9 show, schematically, in three orthogonal views, a reel-up for reeling paper onto reel shafts in accordance with the invention.

DETAILED DESCRIPTION OF PREFERRED EMBODIMENTS

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 shows a first embodiment of a reel shaft 1 in accordance with the invention. Only one of the ends of the reel shaft 1 is shown in FIG. 1. However, the other end of the reel shaft 1, not illustrated, is identical to the first, shown end, unless otherwise specified. For this reason the following description refers to the shown end only. This also applies to the subsequent FIGS. 2-4. The reel shaft 1, here shown in its simplest form, comprises a hollow, tubular sleeve 2 that is axially symmetrical about the axis of rotation 3 of the reel shaft 1.

The sleeve 2 has an envelope surface 4, on which the initial wrapping of a paper web is intended to be performed during reeling in a reel-up, and also an internal surface 5 that defines a passage or channel 6 running axially through the sleeve 2 and terminating in an axial opening 7 at each end of the sleeve 2. The internal surface 5 of the sleeve 2 exhibits a surface portion 8 at each end of the sleeve 2. Prior to a reeling sequence, the axial openings 7 of the sleeve 2 are intended to receive two opposing engagement members 32, 33 (see FIG. 6) in the reel-up. In connection with a reeling sequence, the engagement members 32, 33 are intended to be introduced into the channel 6 of the sleeve 2 to cooperate with and, by means of a locking device, form a detachable engagement with the surface portions 8. When paper has been reeled onto the reel shaft 1 and the same is full, the engagement members 32, 33 at both ends of the reel shaft 1 are arranged to be extracted from the sleeve 2. The sleeve 2 and the paper reeled onto the sleeve 2 thus form a finished paper roll and the sleeve 2 accompanies the paper roll to subsequent processing procedures.

The sleeve 2 is self-supporting, that is to say that no spindle or axial support element is intended to be introduced into the sleeve 2 to support the same during reeling. Accordingly, the sleeve 2 itself must satisfy the strength requirements made on a reel shaft. In accordance with the invention, the sleeve 2 consists mainly of fiber-reinforced plastic, that is a fiber material impregnated with a suitable plastic material. Preferably, the fibers in the fiber-reinforced plastic consist of carbon, aramid, or glass fibers, wound onto an arbor, and the plastic consists of thermo-setting plastic, which is caused to impregnate the fibers wound onto the arbor during the manufacture of the sleeve 2 and thereafter to harden. During the sleeve's manufacture, the strength properties of the sleeve 2, for instance the modulus of elasticity of the sleeve 2, can be controlled in that two consecutive winding turns of fibers are wound at respectively disparate angles. The plastic composite configuration of the sleeve 2 ensures that the reel shaft 1 exhibits a strength that is on a par with a conventional reel shaft comprising a steel reel spool. The reel shaft 1 is much lighter, however. By way of illustration, it is noted that a 5.5 m long reel shaft in accordance with the invention, satisfying the requisite strength criteria, can weigh as little as 800 kg, whereas a corresponding conventional reel shaft comprising a steel reel spool weighs approximately 3100 kg. It should thus be understood that the problems relating to the great weight and moment of inertia of conventional reel shafts described previously can be significantly alleviated with a reel shaft 1 in accordance with the invention. The length of the reel shaft 1 corresponds suitably to the machine width of the paper machine in which the reel shaft 1 is intended to be used, which length is usually in the range 2-8 m. The diameter of the sleeve 2 is preferably in the range 310-800 mm and the material thickness of the sleeve 2 in the range 15-36 mm.

FIG. 2 shows a second embodiment of a reel shaft 9 in accordance with the invention, which reel shaft 9 is especially suitable for use when a relatively brittle fiber material, such as carbon fibers, is used in the sleeve 2. The reel shaft 9 comprises two reinforcement members 10, arranged one at each end of the sleeve 2 to cooperate with said engagement members 32, 33. Each reinforcement member 10 has the shape of a rotationally symmetrical, tubular metal ring that is concentric with the sleeve 2. The metal ring 10 has an inner portion 11, penetrating into the sleeve 2 to form a rigid joint with the same, and also an outer portion 12, protruding from the end of the sleeve 2. The inner portion 11 has an external surface 14, contacting the surface portion 8 of the sleeve 2 and rigidly joined to the same. The metal ring 10 has an internal surface 15, defining a channel 16 that runs axially through the metal ring 10, which channel 16 communicates with the channel 6 of the sleeve 2. In this case, the engagement members 32, 33 of the reel-up are intended to be introduced into the channels 16 of the metal rings 10 to cooperate with and, by means of a locking device, form a detachable joint with the internal surfaces 15 of the metal rings 10, whereby the sleeve 2 is protected against wear and tear.

FIG. 3 shows a third embodiment of a reel shaft 17 in accordance with the invention. The reel shaft 17 is in all respects identical to the reel shaft 1 in FIG. 1, except that the envelope surface 4 of the sleeve 2 in this case exhibits a plurality of holes 18 passing through it. In connection with the initial wrapping of the paper web around the reel shaft 17, a negative pressure is created inside at least a part of the reel shaft 17 by means of air being drawn out from the sleeve 2 in a way that will be further described in the following in connection with FIGS. 6-9. During the wrapping, air is drawn in through the holes 18 and the paper web is attached to the envelope surface 4 of the sleeve 2 by suction. Due to the modest weight of the sleeve 2, the disposition of the holes 18 must be considered so that the reel shaft 17 is not unbalanced. It is important that the holes 18 are evenly distributed across the envelope surface 4 in the rotational direction of the reel shaft 17. In a preferred disposition, the holes 18 are arranged in rows in the longitudinal direction of the sleeve 2, whereby the sleeve 2 exhibits recurring rows of holes in its rotational direction with intervening envelope-surface parts free of holes. Shown in the drawing is a hole configuration that has proved to be especially effective, in which the holes are arranged in four rows 19, of which only three are illustrated in FIG. 4. The rows 19 of holes extend along the entire length of the sleeve and are substantially parallel to the axis of rotation 3 of the reel shaft 17, and in the rotational direction of the sleeve 2, the rows 19 of holes recur every quarter of a turn. In an alternative hole configuration, shown in FIG. 5, the holes are arranged in two rows 19 of holes, which extend along the entire length of the sleeve 2, are substantially parallel to the axis of rotation 3 of the reel shaft, and recur every half a turn in the rotational direction of the sleeve. In common with the sleeve shown in FIG. 1, the internal surface 5 of the sleeve 2 exhibits a surface portion 8 at each end for cooperating with said engagement members.

FIG. 4 shows a fourth embodiment of a reel shaft 20 in accordance with the invention. The reel shaft 20 is in all respects identical to the reel shaft 17 in FIG. 3, except that the reel shaft 20 in this case comprises two reinforcement members 21 in the form of metal rings. The metal rings 21 are in all respects identical to the metal rings 10 in FIG. 2, except that the internal surface 15 of each metal ring 21 exhibits bar grooves or splines 22 for cooperating with said engagement members. Preferably, the engagement members in this case exhibit corresponding external bar grooves or splines.

FIG. 5 shows a fifth embodiment of a reel shaft 23 in accordance with the invention. In this case, the sleeve 2 of the reel shaft 23 comprises two identical, hollow and tubular sleeve parts 24, 25 that are axially symmetrical about a common axis of rotation 3, which also forms the axis of rotation of the reel shaft 23. The sleeve parts 24, 25 are joined to each other by a connection arrangement 26. Each sleeve part 24, 25 has an envelope surface 4 and an internal surface 5 defining an axial channel 6. The internal surface 5 of each sleeve part 24, 25 exhibits, at the end facing the other sleeve part 25, 24, a surface portion 27 that cooperates with the connection arrangement 26. The connection arrangement 26 has the shape of a sleeve that is rotationally symmetrical about the axis of rotation 3 and which has two end portions 28, 29, each of which penetrates into a sleeve part 24, 25, respectively. The connection arrangement 26 exhibits an axial channel 30 running through it. Each end portion 28, 29 has an external surface 31 that connects to the surface portion 27 of the adjoining sleeve part 24, 25 and forms a joint with the same. The joint can be rigid, such as a glue joint, but preferably the joint between the connection arrangement 26 and at least one of the sleeve parts 24, 25 is detachable, by means of a suitable locking device (not shown), whereby the sleeve parts 24, 25 can be detached from each other when need be. The connection arrangement 26 can for instance comprise manually or pneumatically controllable gripping devices that can be removed from and inserted into the end portions 28, 29 in the radial direction to form a detachable friction joint with the opposite surface portions 27. The channel 30 of the connection arrangement 26 communicates with the channels 6 of the sleeve parts 24, 25, whereby the reeling shaft 23 exhibits a channel that runs through it axially and terminates in an axial opening 7 at each end of the reeling shaft 23. The internal surfaces 5 at each axial opening exhibit surface portions 8 for cooperating with said engagement members 32, 33. Each sleeve part 24, 25 exhibits in its envelope surface 4 a plurality of holes 18 passing through the same and arranged in two rows, of which only one row 19 is visible in FIG. 5. The rows 19 of holes extend along the entire length of the sleeve part 24, 25, are substantially parallel to the axis of rotation 3 and recur every half a turn in the rotational direction of the reel shaft 23. For the reel shaft 23 to be balanced the two sleeve parts 24, 25 are arranged in relation to each other so that the rows 19 of holes in the sleeve part 24 are aligned with the rows 19 of holes in the sleeve part 25.

In the following, the previously described engagement members 32, 33, and the manner in which they cooperate with a reel shaft in accordance with the invention, will be described with reference to FIG. 6. FIG. 6 shows how the reel shaft 23 described in FIG. 5 cooperates with the engagement members 32, 33; however, the cooperative principle is applicable to all the reel shafts previously described. Each engagement member 32, 33 comprises a first part 34 and a second part 35, telescopically retractable into the first part. The engagement members 32, 33 can assume a first position in which the second parts 35 of the engagement members 32, 33 are retracted inside the first parts 34 and in which the engagement members 32, 33 do not cooperate with the reel shaft 23, and also a second position in which the second parts 35 of the engagement members 32, 33 project from the first parts 34 and in which the engagement members 32, 33 cooperate with the reel shaft 23. The second parts 35 of the engagement members 32, 33 have an engagement portion 36 that is arranged to be inserted into the ends of the reel shaft 23 to cooperate with the surface portions 8 (see FIG. 5) and to form a detachable engagement with the same. The engagement portions 36 comprise appropriate locking devices (not shown) in the form of pneumatically controllable gripping devices that can be removed from and inserted into the engagement portions 36 in the radial direction to form a detachable friction joint with the opposite surface portions 8. The engagement member 33 exhibits a channel 37 that runs axially through it and communicates with the channel 6 of the sleeve part 24 and also with the channel 6 of the sleeve part 25, via the channel 30 of the connection arrangement 26. The engagement member 32 has no channel running through it and the axial opening 7 of the sleeve part 25 is thus closed by the engagement portion 36 of the engagement member 32. The first part 34 of the engagement member 33 exhibits a recess 38 in the form of a truncated cone. The recess 38 is arranged to receive a nozzle that is connected to a vacuum system (see FIGS. 7-9), whereby air can be extracted from the reel shaft 23 by suction to create a negative pressure inside it. As the sleeve parts 24, 25 are manufactured mainly of plastic composite material, thus being lightweight, it is possible to fashion the channel 37 of the engagement member 33 with a cross-sectional area that is relatively large. This prevents the engagement member 33 from becoming an obstacle in the flow path of the air being extracted from the reel shaft 23.

FIGS. 7-9 schematically show three orthogonal views of a reel-up in a paper machine in which paper is continuously manufactured in a coherent web 40. FIG. 7 shows the reel-up from the operator side of the paper machine, FIG. 8 shows the reel-up from above, and FIG. 9 shows the reel-up from the downstream end of the paper machine. For the sake of clarity, certain concealing parts have been removed in FIGS. 8 and 9, which is indicated in the text wherever applicable. The paper web 40 is continuously reeled onto reel shafts 23 in the reel-up. In FIGS. 7-9 the reel shaft are of the type shown in FIGS. 5 and 6, but the reel shafts can in principle be any of the other embodiments described above. The reel-up comprises two parallel and mirror-inverted, but otherwise identical stand parts 41, 42, extending in the longitudinal direction of the paper machine. The first stand part 41 is placed on the operator side of the paper machine, and the other stand part 42 is placed on the drive side of the paper machine. The paper machine comprises a support member in the form of a reel drum 43, over which the paper web 40 runs. The paper machine further encompasses a wire-turning roll 44, located downstream and below the reel drum 43 and arranged parallel to the same. The reel drum 43 and the wire-turning roll 44 are both rotatably journalled on the stand parts 41, 42. An endless belt 45 passes over the reel drum 43 and the wire-turning roll 44 and supports the paper web 40, coming from the drying section (not shown) of the paper machine, during its transportation to the reel-up. A drive motor (not shown) rotates the reel drum 43 at a peripheral speed corresponding to the speed of travel of the belt 45 and, therefore, of the paper web 40. Alternatively, the reel drum 43 can be driven by the belt 45, which passes over a plurality of rolls, of which one, for instance the wire-turning roll 44, then is driving. In an alternative embodiment (not shown), said belt is lacking and the paper web passes directly on the reel drum.

A stock 46 of empty reel shafts 23 is located at the upstream end of the reel-up, above the reel drum 43. The stock 46 comprises a substantially horizontal shelf 47, on which the empty reel shafts 23 rest next to each other and parallel to the reel drum 43, waiting to be reeled in the reel-up. The reel-up comprises an advancement unit 48 in the form of a carriage, which is mounted on rails 49 to be linearly movable for collecting the empty reeling shafts 23 sequentially from the stock 46 and bringing them with the aid of lowering arms 50 to a reeling system for reeling. In FIG. 8, the stock 46 and the advancement unit 48 are removed for the sake of clarity.

Said reeling system comprises a first movable unit 51 and a mirror-inverted second movable unit 52 in the form of carriages. Each carriage 51, 52 comprises two parallel carriage bodies 53, 54, each mounted on one of the stand parts 41, 42, respectively, to be linearly movable in the longitudinal direction of the paper machine. For this purpose, the reel-up comprises actuators (not shown), arranged to influence the movement back and forth of the carriages 51, 52 in the longitudinal direction of the paper machine and consisting of, for instance, hydraulic or pneumatic piston cylinders. Each carriage body 53, 54 comprises a sledge 55, cooperating with one of the stand parts 41, 42, respectively, and also a pivot unit 57, pivotably mounted about a rotary shaft 56 on the sledge 55. The rotary shafts 56 are parallel to the reel drum 43, and each pivot unit 57 can be raised and lowered in relation to its sledge 55 by a pivoting movement about its rotary shaft 56 with the aid of a hydraulic or pneumatic piston cylinder 58. In each carriage 51, 52, the two engagement members 32, 33 described in connection with FIG. 6 are rotatably journalled on the pivot units 57 to cooperate and form a detachable engagement with the ends of the reeling shafts 23 in the way described above.

The reel-up comprises a vacuum system, which here denotes a system for creating a predetermined pressure below normal atmospheric pressure. The vacuum system encompasses a first vacuum unit 59, situated on the operator side of the paper machine in the vicinity of the reel drum 43, and a mirror-inverted second vacuum unit 60, situated on the drive side of the paper machine in the vicinity of the reel drum 43. Each vacuum unit 59, 60 comprises an air pipe 61, which at one of its ends (not shown) is connected to a vacuum pump or a partial-pressure tank (not shown). Each air pipe 61 is, at its other end, connected to a nozzle 62. Each nozzle 62 is movably mounted on a stand 67 so that the nozzle 62 can perform a linear movement in the transverse direction of the paper web 40 as well as a movement in the longitudinal direction of the paper machine and a movement in the vertical direction. Each engagement member 33 is arranged to receive one of the nozzles 62 at its recess 38 (see FIG. 6) in connection with a reeling sequence. In the phase shown in FIGS. 7-9, the first carriage 51 supports a reel shaft 23', which is just about to take over reeling from a reel shaft 23" supported by the second carriage 52, and the engagement member 33 of the first carriage 51 is connected to the nozzle 62 of the first vacuum unit 59 to create a 20 negative pressure in the reel shaft 23'. In this phase, the second vacuum unit 60 is inactive and starts to act only when the second carriage 52 is transported to the reel drum 43 to receive an empty reel shaft 23, the nozzle 62 of the second vacuum unit 60 then being brought into engagement with the engagement means 33 of the second carriage 52.

To accelerate an empty reel shaft 23' in connection with a reeling sequence and thereafter to control the rotational speed of the reel shaft 23", each carriage body 53 comprises an auxiliary drive system, that is arranged to drive, i.e. to rotate, the engagement member 32 on the carriage body 53 during a reeling sequence. For this purpose, the auxiliary drive system comprises a drive device 63, which can consist of an electric motor rigidly mounted on the carriage body 53, and a drive belt transmitting the turning torque of the motor to the engagement member 32.

A reeling sequence encompasses the following. The starting position is as shown in FIGS. 7-9. The first carriage S1 has deposited a fully reeled paper roll 64 onto a transport carriage 65 and is located by the reel drum 43, where it has received an empty reel shaft 23' from the advancement carriage 48. A paper roll 66 is in the process of being reeled on the second carriage 52. For the sake of clarity, the paper rolls 64 and 66 are removed in FIG. 9. The engagement members 32, 33 on the first carriage 51 are thus connected to the reel shaft 23'. The pivot units 57 of the carriage 51 are at this stage in a raised position and the reel shaft 23' is not in contact with the paper web 40. When the paper roll 66 on the second carriage 52 is almost full, the reel shaft 23' situated on the first carriage 51 is caused to rotate at the same speed as the reel drum 43 with the aid of the drive device 63 of the first carriage 51. At the same time, a negative pressure is created inside the reel shaft 23' with the aid of the first vacuum unit 59. Thereafter the reel shaft 23' is moved towards the reel drum 43 by lowering the. pivot units 57, after which the paper web 40 is deflected up towards the reel shaft 23' by a stream of air from one or several blow pipes (not shown) arranged below the paper web 40 just downstream of the reel drum 43, whereupon the paper web 40 is attached to the reel shaft 23' by suction and the paper web 40 is wrapped around the reel shaft 23'. During wrapping, the contact between the paper web 40 and the paper roll 66 on the second carriage 52 is broken, the reeling of the paper web 40 being transferred to the first carriage 51. The now fully reeled paper roll 66 is thereafter transported by the second carriage 52 to an empty transport carriage (not shown), where the paper roll 66 is deposited, whereupon the second carriage 52 is transported upstream to the reel drum 43. When the paper roll on the first carriage 51 begins to be fully reeled, the advancement unit 48 collects an empty reel shaft 23 from the stock 46 and brings it to the second carriage 52. The engagement members 32, 33 of the second carriage 52 are thereafter introduced into the end of the empty reel shaft, whereupon the lowering arms 50 of the advancement unit 48 release the reel shaft, which reel shaft at this stage is ready to be accelerated by the drive device 63 of the second carriage 52, connected to the second vacuum unit 60 and lowered towards the paper web 40 to take over the reeling from the reel shaft 23' when this is full.

The invention has been described above with reference to several embodiments. However, it should be understood that the invention is not limited to these. For instance, a reel shaft of the type shown in FIG. 5 can comprise three or more sleeve parts. Such a segmented reel shaft is especially favourable in cases where the paper web is divided in its longitudinal direction during reeling. By placing the joints between the sleeve parts during reeling at the dividing points of the paper web, the finished paper roll can easily be divided into part reels by detaching the sleeve parts from each other. The detaching can be performed by introducing an elongate instrument into one of the axial openings of the reel shaft to release said gripping devices, for instance. The connection arrangement 26 described in connection with FIG. 5 exhibits a channel 30 running axially through the same. Alternatively, the connection arrangement can comprise a dividing wall, separating the channels 6 of the sleeve parts 24, 25. In certain situations this can be favorable since in such a case it is easier to achieve a substantial negative pressure in the part or parts to which the vacuum system is connected.

What is claimed is:

1. A reel shaft for reeling a paper web in a reel-up in a paper machine, which reel-up includes at least one unit that is mobile in a longitudinal direction of the paper machine and supports a pair of opposite engagement members each of which includes an engagement part, the engagement parts being arranged for rotatably carrying and detachably engaging the reel shaft during reeling, wherein the reel shaft is free of a support shaft and comprises a self-supporting, tubular sleeve substantially formed of fiber-reinforced plastic, the sleeve having an envelope surface on which initial wrapping of the paper web shall be performed, and also an internal surface defining an axial channel through the sleeve, the axial channel terminating in axial openings at the ends of the reel shaft, the reel shaft being arranged to receive the engagement parts in said axial openings to allow formation of said detachable engagement.

2. A reel shaft as claimed in claim 1, wherein the internal surface of the sleeve at each end of the reel shaft has a surface portion for cooperating with said engagement parts.

3. A reel shaft as claimed in claim 1, wherein the internal surface of the sleeve at each end of the reel shaft has a surface portion and the reel shaft at each end thereof includes a tubular reinforcement member that has an inner portion that is inserted into the sleeve and defines an external surface rigidly connected to the surface portion of the sleeve, as well as an internal surface for cooperating with said engagement parts.

4. A reel shaft as claimed in claim 1, wherein the sleeve defines a plurality of through-running holes extending from the internal surface to the envelope surface of the sleeve, and a channel is defined running axially through at least one of said engagement members for causing the holes to communicate with a vacuum system to create a negative pressure inside at least a part of the reel shaft for drawing air through the holes and thereby attaching the paper web to the envelope surface of the sleeve during wrapping.

5. A reel shaft as claimed in claim 4, wherein the holes are arranged in rows that extend parallel to a rotational axis of the sleeve and are uniformly spaced apart in a rotational direction of the sleeve such that the sleeve in the rotational direction defines recurrent rows of holes with intervening envelope-surface portions free of holes.

6. A reel shaft as claimed in claim 5, wherein the sleeve defines four rows of holes, the rows recurring in the rotational direction of the sleeve every quarter of a turn.

7. A reel shaft as claimed in claim 5, wherein the sleeve defines two rows of holes, which rows recur in the rotational direction of the sleeve every half a turn.

8. A reel shaft as claimed in claim 1, wherein the sleeve includes at least two sleeve parts having a common rotational axis and connected to each other by means of a connection arrangement.

9. A reel shaft as claimed in claim 8, wherein the sleeve parts are detachably connected to each other.

10. A reel shaft as claimed in claim 1, wherein the fibers in the fiber-reinforced plastic are selected from the group consisting of carbon, aramid, and glass fibers, and the plastic comprises thermosetting plastic.

11. A reel-up in a paper machine, in which paper is continuously manufactured in a coherent web that is wound onto reel shafts in the reel-up to form paper rolls, in which the reel shafts constitute reeling cores, which reel-up includes a stock of empty reel shafts, an advancement unit arranged to move the empty reel shafts sequentially from the stock to a reeling system, and said reeling system, including at least one unit that is mobile in the longitudinal direction of the paper machine and supports a pair of opposite engagement members each of which includes an engagement part, which engagement parts are arranged for rotatably carrying and detachably engaging the reel shafts during reeling, wherein each reel shaft is free of a support shaft and comprises a self-supporting, tubular sleeve substantially formed of fiber-reinforced plastic, which sleeve has an envelope surface on which the initial wrapping of the paper web shall be performed, and also an internal surface defining an axial channel in the sleeve, the axial channel terminating in axial openings at opposite ends of the reel shaft, the engagement parts being linearly mobile in the transverse direction of the paper web so as to be insertable into the axial openings during a reeling sequence, the reel shafts being arranged to receive the engagement parts in the axial openings of the reel shaft to allow formation of said detachable engagement.

12. A reel-up as claimed in claim 11, wherein the fibers in the fiber-reinforced plastic are selected from the group consisting of carbon, aramid, and glass fibers, and the plastic comprises thermosetting plastic.

13. A reel-up as claimed in claim 11, wherein each reel shaft includes a tubular reinforcement member at each end of the reel shaft for engaging the engagement parts, each reinforcement member being inserted into the axial opening of the sleeve, an external surface of each reinforcement member being rigidly connected to the internal surface of the sleeve, an internal surface of each reinforcement member cooperating with the engagement part that is inserted into the reinforcement member during a reeling operation.

14. A reel-up as claimed in claim 11, wherein the sleeve of each reel shaft defines a plurality of holes extending from the internal surface to the envelope surface of the sleeve for exerting negative pressure on the paper web initially wrapped about the reel shaft, and wherein at least one of the engagement part defines a flow path that is connected to a vacuum system operable to create a negative pressure in the axial channel of the reel shaft to which the engagement part is connected.

15. A reel-up as claimed in claim 14, wherein the holes in the sleeve of each reel shaft are arranged in a plurality of rows that extend parallel to a rotational axis of the reel shaft and that are uniformly spaced apart in a rotational direction of the reel shaft.

16. A reel-up as claimed in claim 11, wherein the sleeve of each reel shaft comprises a plurality of sleeve parts having a common rotational axis and connected to each other by a connection arrangement.

17. A reel-up as claimed in claim 16, wherein the connection arrangement provides a detachable connection between the sleeve parts.

18. A method for reeling a paper web in a reel-up in a paper machine, the method comprising the steps of:

supplying a reel shaft to the reel-up, the reel shaft being free of a support shaft and comprising a self-supporting, tubular sleeve substantially formed of fiber-reinforced plastic, the sleeve having an envelope surface on which initial wrapping of the paper web shall be performed, and also an internal surface defining an axial channel through the sleeve, the axial channel terminating in axial openings at the ends of the reel shaft;

engaging the reel shaft by a pair of opposite engagement members of the reel-up, each engagement member including an engagement part, the engagement parts engaging the reel shaft in said axial openings;

accelerating the reel shaft to a rotational speed equivalent to the speed of the paper web;

initiating a reeling sequence by wrapping the paper web around the reel shaft;

completing a paper roll on the reel shaft while the reel shaft is held by the engagement members;

disengaging the engagement members from the reel shaft; and removing the paper roll on the reel shaft from the reel-up.

19. A method as claimed in claim 18, further comprising the step of creating a negative pressure in the reel shaft prior to initiating the reeling sequence.

20. A method as claimed in claim 18, wherein said disengaging step is performed when the paper roll is supported by a transport carriage.

21. A reel shaft for reeling a paper web in a reel-up in a paper machine, comprising:

a self-supporting, tubular sleeve substantially formed of fiber-reinforced plastic, the sleeve having a diameter of 310 to 800 mm, a wall thickness of 15 to 36 mm, and a length of 2 to 8 m, the sleeve having an envelope surface on which initial wrapping of the paper web shall be performed, and an internal surface defining an axial channel through the sleeve, the axial channel terminating in axial openings at the ends of the reel shaft, the axial openings being arranged to receive engagement parts of a reel-up for rotatably carrying and detachably engaging the reel shaft during reeling, whereby the reel shaft is free of a support shaft.

* * * * *

UNITED STATES PATENT AND TRADEMARK OFFICE

CERTIFICATE OF CORRECTION

PATENT NO. : 7,503,520 B2
APPLICATION NO. : 10/331112
DATED : March 17, 2009
INVENTOR(S) : Eriksson et al.

It is certified that error appears in the above-identified patent and that said Letters Patent is hereby corrected as shown below:

Column 1,
Line 41, “modem” should read --modern--.

Column 9,
Line 30, cancel “20”.

Signed and Sealed this

Ninth Day of June, 2009

John Doll

JOHN DOLL
*Acting Director of the United States Patent and Trademark Office*